United States Patent [19]

Cavanagh

[11] Patent Number: 4,612,755

[45] Date of Patent: Sep. 23, 1986

[54] BLISTER PACK LAMINATING DEVICE AND METHOD

[75] Inventor: Michael J. Cavanagh, St. Paul, Minn.

[73] Assignee: Minnesota Mining and Manufacturing Company, St. Paul, Minn.

[21] Appl. No.: 758,530

[22] Filed: Jul. 24, 1985

[51] Int. Cl.[4] ..... B65B 7/16

[52] U.S. Cl. ..... 53/485; 53/300; 53/371; 53/390; 156/362; 156/522

[58] Field of Search ..... 53/140, 300, 389, 390, 53/373, 427, 485, 371; 156/361, 362, 363, 353, 355, 522

[56] References Cited

U.S. PATENT DOCUMENTS

| | | | |
|---|---|---|---|
| 3,378,991 | 4/1968 | Anderson | 53/390 |
| 3,693,318 | 9/1972 | Balzer et al. | 53/389 |
| 3,856,144 | 12/1974 | Kelly | 206/462 |
| 4,002,009 | 1/1977 | Teloon et al. | 53/296 |
| 4,510,014 | 4/1985 | Artusi et al. | 156/522 |

*Primary Examiner*—John Sipos
*Assistant Examiner*—Donald R. Studebaker
*Attorney, Agent, or Firm*—Donald M. Sell; James A. Smith; Allen W. Wark

[57] ABSTRACT

A device and method for laminating a barrier film to a blister pack utilizing a two-cycle, reciprocatory carriage assembly. The carriage assembly includes a tray upon which the blister pack is placed and reciprocated in and out of the device housing. During one cycle, the barrier film is prevented from contacting the blister pack by means of a pair of rollers which back the film away from the blister pack a predetermined distance. During the other cycle, the rollers advance the barrier film toward and in contact with the blister pack to apply the film. In addition, the rollers apply pressure through the film and blister pack against preselected pressure or bonding areas associated with the tray sufficient to bond the film to the pack. Different types of blister packs may be laminated by the device by changing the tray to include the necessary pressure or bonding areas.

20 Claims, 7 Drawing Figures

BLISTER PACK LAMINATING DEVICE AND METHOD

FIELD AND BACKGROUND OF THE INVENTION

The present invention relates to a laminating device and method, and more particularly, a laminating device and method for laminating a one sided pressure sensitive adhesive coated barrier film to a blister pack and cutting the laminated barrier film.

Present laminating devices are of a continuous operating nature usually done by large laminating, folding, feeding and cutting machines. However, such activity is done at the point of manufacture and is only feasible on a large scale continuous basis. Thus, the ease and convenience of blister pack packaging has not been available to small businesses such as drug stores, hardware stores, sporting good stores and the like which require an inexpensive, compact device for on premise use.

Several attempts have been made to meet the needs of small businesses without recourse to specialized machinery. These attempts have included blister packaging by hand and by the use of a hand operated device, as disclosed in U.S. Pat. Nos. 3,856,144, and 4,002,009, the disclosures of which are hereby incorporated by reference. Consequently to date, small businesses have only been provided with two alternatives. They could either apply a pressure sensitive adhesive by hand to a blister pack, or they could place a blister pack on a device and slide it through the device in contact with an adhesive, whereby the adhesive was applied to the blister pack. Both are cumbersome and inefficient in meeting such varying business needs from occasional blister packaging to semi-continuous blister packaging. Thus, there is a need for a device which can easily be used to package a few items or effectively and efficiently used to package a multitute of items on a semi-continuous basis.

The prior art as described above has not yet recognized a need for a blister pack laminating device and method which is compact, easily operated by either hand, requires no external energy source, and is effectively and efficiently used for packaging relatively few items or for packaging items on a semi-continuous basis. Finally, notwithstanding the simplicity of construction and compactness, the device must be adaptable to laminate a multitude of items which may require lamination of different sized and shaped blister packs.

SUMMARY OF INVENTION

The present invention provides a novel blister pack laminating device and method particularly adapted for laminating a one sided pressure sensitive adhesive coated barrier film to a preformed blister pack. Specifically, according to the principles of the present invention, the device includes a housing, a two-cycle carriage assembly, a tray upon which the blister pack is placed, a barrier film applicator for applying the barrier film to the planar side of the blister pack during either of the cycles and a cutting blade for cutting the film after it has been laminated to the blister pack. The two-cycle carriage assembly is attached to the housing for reciprocatory, linear movement into the housing during one cycle and out of the housing during one cycle.

An important feature of the device and method is to provide pressure through the film and blister pack against preselected pressure or bonding areas associated with the tray sufficient to bond the barrier film to the blister pack. An additional feature includes a pair of rollers connected to the barrier film applicator whereby the pressure is applied by at least one of the rollers as the film is applied to the blister pack.

A further feature of the invention includes preventing the barrier film from contacting the blister pack during one of the cycles, whereby the barrier film is held between the rollers and is backed away from the blister pack, and applying the barrier film to the blister pack during the other cycle, whereby the pair of rollers advance the film toward and in contact with the blister pack to apply it. In addition, the backward rotation of the rollers is stopped by means of a pair of cams so that the barrier film is only backed away from the blister pack a predetermined amount so that the film remains between the rollers, and the cams are adapted for initiating the rotation of the rollers during the other cycle to apply the film to the blister pack.

It is further contemplated that the tray is releasably retained on the carriage assembly and includes a grate having bonding or pressure areas associated therewith. Thus, different trays having different grate configurations associated therewith, may be utilized with the present device to enable the user to laminate blister packs having a different size or blister configuration by the present device or in accordance with the present method.

DESCRIPTION OF THE DRAWINGS

The various features, objects, benefits, and advantages of the present invention will become more apparent by reading the following detailed description in conjunction with the drawings where like reference numerals identify corresponding components.

DETAILED DESCRIPTION OF THE PREFERRED EMBODIMENT

Figure 1:
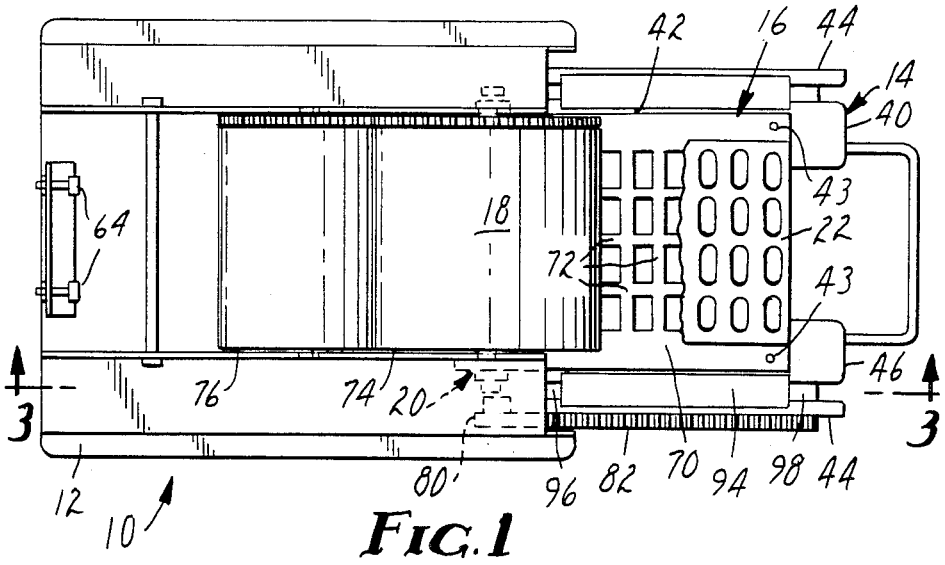
FIG. 1 is a plan view of the blister pack laminating device of the present invention.
Figure 2:
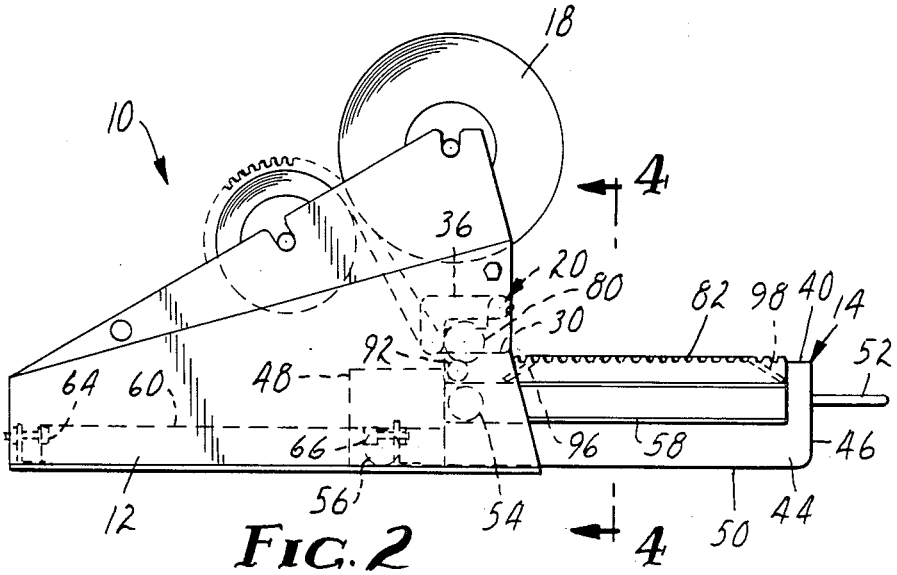
FIG. 2 is a side view of the device of FIG. 1.

Referring to FIGS. 1 and 2 of the drawings, the blister pack laminating device of the present invention, generally designated 10, comprises a housing 12, a two-cycle carriage assembly 14, a tray 16, a roll of barrier film 18, and a barrier film applicator generally designated 20 for laminating the barrier film to blister pack 22 during cycling.

Figure 3:
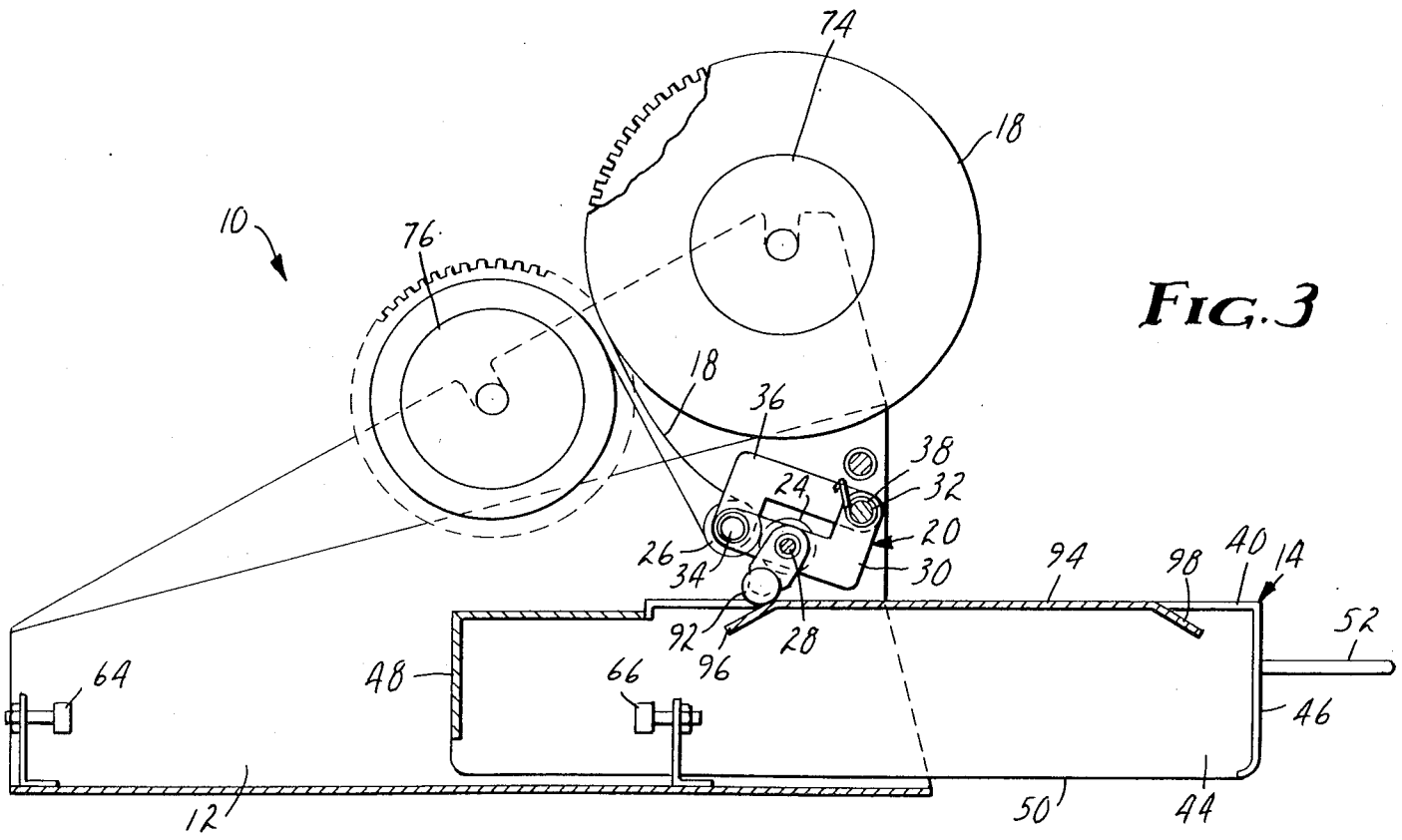
FIG. 3 is a fragmentary vertical sectional view taken in the direction of arrows 3—3 of FIG. 1.
Figure 4:
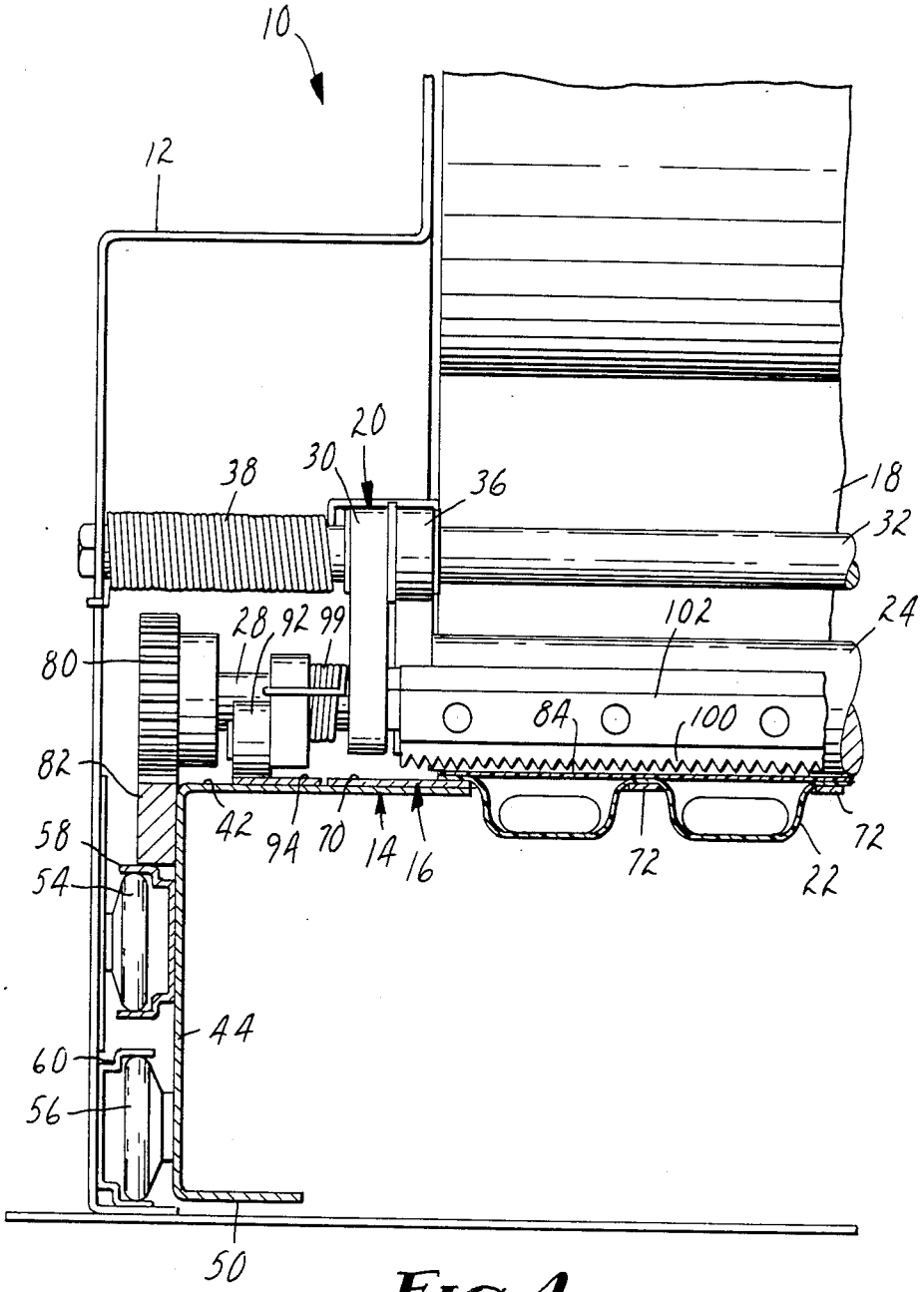
FIG. 4 is an enlarged fragmentary transverse sectional view taken in the direction of arrows 4—4 of FIG. 2.

Applicator assembly 20 includes a pair of rollers consisting of an applying roller 24 and a nip roller 26 (FIGS. 3 and 4). Applying roller 24 has a support shaft 28 running along the longitudinal axis of the roller to allow free rotation of the roller during cycling. A support arm 30 attaches shaft 28 and roller 24 to a central support shaft 32. Similarly, the nip roller 26 has a support shaft 34 running along the longitudinal axis of the roller to allow free rotation of the roller during cycling. An arm 36 attachs roller 26 to the central shaft 32. A pair of torsion springs 38 on the shaft 32 bias the arms 36 and roller 26 into frictional counter clockwise engagement with roller 24.

Carriage assembly 14 includes a bed 40 moveably supported within housing 12 for reciprocatory, linear movement into the housing during one cycle and out of the housing during one cycle. Bed 40 includes a top 42, sides 44, front 46, back 48 and bottom 50 (FIGS. 2 and 3). Bed 40 is supported within housing 12 by two sets of rollers 54 and 56 (FIGS. 2 and 4). Rollers 54 are connected to housing 12 opposite bed sides 44, and engage a track 58 affixed along each side 44 of the bed 40. To provide balance and stability to the bed during cycling, additional tracks 60 are attached to housing 12 opposite bed sides 44, and rollers 56 are attached to bed sides 44 near back 48 of the bed 40 and are engageable with track 60. A handle 52 attached to bed front 46 enables the user to grasp it with one hand to reciprocate carriage assembly 14 in and out of the housing.

Stops 64 are attached to the housing 12 and are engageable with the outside surface of bed back 48 to terminate linear movement of bed 40 when it is cycled into the housing (FIGS. 2 and 3). In addition, stops 66 are attached to housing 12, and are engageable with the inside surface of bed back 48 to stop linear movement of bed 40 when it is cycled out of the housing.

Tray 16 includes a preselected grate 70 having pressure or bonding areas 72 associated with the top surface thereof (FIG. 1 and 4). Areas 72 correspond to the desired laminating areas of the preselected blister pack 22. Tray 16 may be releasably retained on bed top 42 by a suitable retaining means so that different grate configurations may be utilized for laminating different blister packs. The particular retaining means 43 should not interfere with or project past the surface of tray 16. The particular means is not essential to the present invention, but, for example, a particular means might include flat head screws at each corner of the tray 16 or a detent means which will provide ease of use and changeability.

The particular barrier film 18 and the material forming the blister pack 22 are not essential to the invention herein, except the adhesive coating on the film and the blister pack material have to be compatible, and be pressure sensitive at room temperature. By way of example, the barrier film 18 is a foil-paper-backed tape having an adhesive copolymer layer which cooperates with a vinyl blister pack, such as that sold by Minnesota Mining and Manufacturing Company, 3M, identified as Medication Backing YR 9612, which has been found to be preferred for laminating multi-compartment blister packs in accordance with the device and method of the present invention. In addition, because the adhesive copolymer layer is substantially non-tacky it does not become strongly bonded to, for example, pills or other forms of medication which can then be easily removed from each blister pack compartment by punching them out the foil-paper laminate. Thus, as illustrated, film 18 is advanced from spool 74 and the film backing is removed from the film and wound upon spool 76 to be discarded when the roll of film 18 is replaced.

To rotate the carriage assembly rollers 24 and 26 during cycling, a gear 80 is attached to the end of applying roller shaft 28, and gear 80 is engageable with rack 82 which runs along the top 42 of carriage bed 40, whereby during inward and outward cycling of the carriage assembly, rollers 24 and 26 rotate to advance or retract a portion 84 of barrier film 18 positioned between the rollers (FIGS. 3 and 4). In addition, at least one of the applicator assembly rollers 24 or 26 is engageably biased towards grate 70 by springs 38 to apply pressure through the barrier film and blister pack against the grate at bonding areas 72 during cycling.

To prevent engagement of applying roller 24 during at least one of the cycles, a pair of cams 92 are attached to the ends of shaft 28 which engage and ride along surfaces 94 of bed top 42 (FIGS. 3 and 4). In addition, to lift the rollers out of engagement with the tray 16 during one of the cycles a pair of upwardly sloping ramps 96 are provided along track surface 94 to prevent film 18 from being applied during one of the cycles. Thus, cams 92, during one cycle, ride up along ramps 96 to lift the rollers away from engagement with blister pack 22 and to lift gear 80 out of engagement with rack 82 after a predetermined portion 84 of film 18 has been retracted.

An additional downwardly sloping pair of ramps 98 are provided at the ends of track surface 94 to lower the pair of rollers in pressure contact with blister pack 22 and to lower gear 80 in engagement with rack 82. Thus, during linear movement of the carriage assembly during the other cycle, rollers 24 and 26 advance film 18 into contact with blister pack 22 to apply it (FIG. 3). A pair of torsion springs 99 bias cams 92 in engagement with cam follower track surface 94 during only one cycle and permit cams 92 to be collapsed out of riding contact with surface 94 during the other cycle. It is contemplated that ramps 96 and 98 be adjustable to change the amount of film 18 applied to the particular blister pack when necessary.

A cutting blade 100 is positioned near the pair of rollers 24 and 26, whereby after laminating film 18 to blister pack 22 the film can be cut (FIG. 4). Cutting blade 100 is fastened to bar 102 and the bar is supported between support arms 30.

OPERATION AND USE

Figure 5:
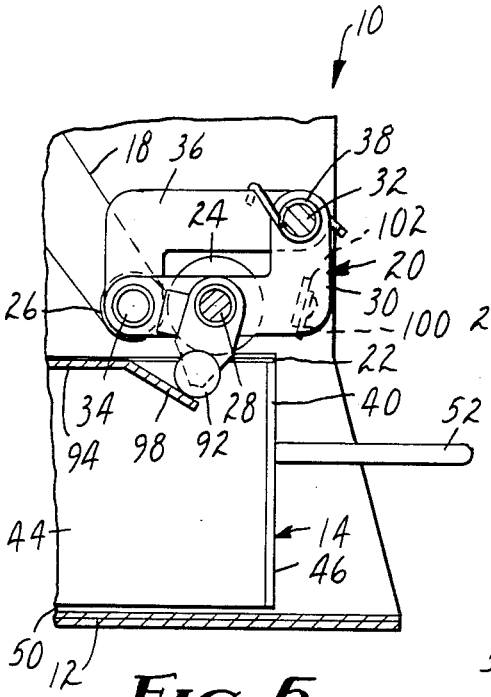
FIG. 5 is a fragmentary vertical sectional view of the details of the applicator and tray assembly on completion of the inward cycle.

The operation and use of the present laminating method may now be explained. A preselected blister pack 22 is placed on tray grate 70. Grate 70 and blister pack 22 each have, associated therewith, the desired pressure or bonding areas 72 corresponding to the preselected blister pack. Next, the user grasps handle 52 with at least one hand and cycles carriage assembly 14 into housing 12. As an example, during the initial portion of the inward cycle, cams 92 engage upwardly inclined ramp surfaces 96 lifting rollers 24 and 26 out of pressure contact with blister pack 22, and gear 80 is disengaged from rotational contact with rack 82 after the rollers have retracted a predetermined portion 84 of the film. As the inward cycle approaches completion, cams 92 descend down ramp surface 98 to allow rollers 24 and 26 to come in pressure contact with blister pack 22, and gear 80 to come in rotational contact with rack 82 to position the rollers 24 and 26 to apply the film 18 (FIG. 5).

Figure 6:
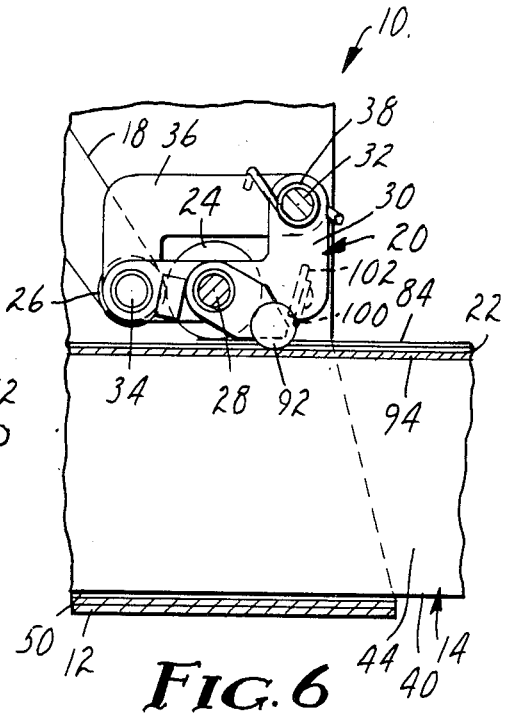
FIG. 6 is a fragmentary vertical sectional view similar to FIG. 5 during the inward cycle.

Next, carriage assembly 14 is cycled out of housing 12 during which cams 92 collapse out of their riding position so that one of the rollers 24 or 26 remains in pressure contact with blister pack 22, and film 18 is advanced in contact with and applied to the blister pack while at least one of the rollers 24 or 26 apply pressure through film 18 and blister pack 22 against pressure or bonding areas 72 (FIG. 6). In addition, as completion of the inward cycle is approached, cams 92 will ride down ramp surfaces 96 to attain their initial riding positions (FIG. 7).

Figure 7:
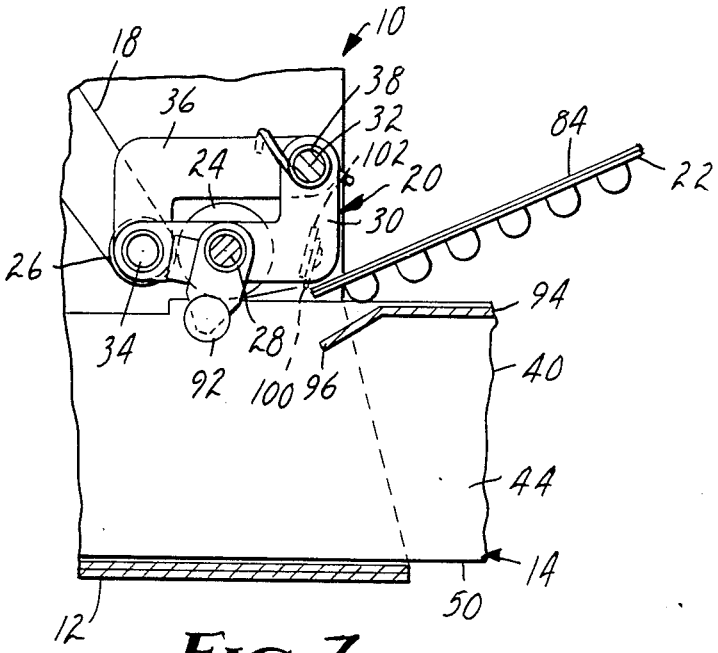
FIG. 7 is a fragmentary vertical sectional view upon completion of the outward cycle illustrating removal of a laminated blister pack from the device.

At the completion of both cycles, the user lifts the laminated blister pack from tray 16 cutting film 18 by its engagement with cutting blade 100 (FIGS. 4 and 7). Thus, angular displacement of the tray during removal will easily and readily cut the film.

The present laminating device and method described herein can be useful for making medication cards having one punch-open compartments per pill. In addition, the device and method may be utilized in laminating a multitude of blister packs having compartments for containing various items, for example, hardware items, sporting good items, or the like.

While a preferred embodiment of the present invention has been described so as to enable one skilled in the art to practice the device and method of the present invention, the proceeding description is intended to be exemplary and should not be used to limit the scope of the invention. The scope of the invention should be determined only by reference to the following claims.

I claim:

1. A device for laminating a barrier film to a blister pack comprising:

a housing;

a two-cycle carriage assembly attached to said housing for reciprocatory, linear movement into said housing during one cycle and out of said housing during one cycle;

tray means for holding a blister pack on said carriage assembly;

barrier film applicator means attached to said housing and including a pair of rollers for laminating a barrier film to said blister pack during either of said cycles;

drive means associated with said barrier film applicator means for rotating said pair of rollers;

holding means associated with said pair of rollers for holding said barrier film between said pair of rollers;

prevention means associated with said barrier film applicator means for preventin said barrier film from coming in contact with and being applied to said blister pack during one of said cycles; and advancing means associated with said barrier film applicator means for advancing said barrier film during said other cycle toward and in contact with said blister pack to apply said barrier film to said blister pack.

2. The device defined in claim 1, wherein said tray means is adapted to include preselected pressure areas to insure proper bonding of said barrier film to said blister pack.

3. The device defined in claim 2, wherein said barrier film applicator means is adapted to apply pressure through said film and said blister-pack against said preselected pressure areas sufficient to bond said barrier film to said blister pack.

4. The device defined in claim 3, wherein said barrier film applicator means is further adapted to apply said pressure as said barrier film is being applied to said blister pack.

5. The device defined in claim 1, further comprising cam means associated with said prevention means for lifting said pair of rollers out of pressure contact with said tray means and for disengaging said drive means from rotating said pair of rollers so that said barrier film is prevented from being applied to said blister pack during one of said cycles, and for lowering said pair of rollers into pressure contact with said tray means and for engaging said drive means for rotating said pair of rollers os that said barrier film is applied to said blister pack during the other of said cycles.

6. The device defined in claim 1, wherein said prevention means is adapted to back said barrier film away from said blister pack to prevent said barrier film from coming in contact with and being applied to said blister pack during one of said cycles.

7. The device defined in claim 6, further comprising cam means connected to said barrier film applicator means for stopping the backward rotation of said rollers during one of said cycles after said barrier film has been backed away from said blister pack a predetermined amount so that said film remains between said rollers and for lifting said rollers away from said blister pack, and is adapted for initiating the rotation of said rollers during the other of said cycles to advance said barrier film toward and in contact with said blister pack to apply said film to said blister pack.

8. The device defined in claim 6, further comprising biasing means connected to said applicator means for biasing at least one of said pair of rollers in pressure contact with said tray means, whereby at least one of said rollers applies pressure through said film and said blister pack against said tray means sufficient to bond said film to said blister pack.

9. The device defined in claim 1, further comprising retaining means for releasably retaining said tray means on said carriage assembly whereby different tray means may be held on said carriage assembly to laminate said barrier film to different, preselected blister packs.

10. The device defined in claim 9, wherein said different tray means is adapted to include different preselected pressure areas to insure proper bonding of said barrier film to said different blister pack when pressure is applied through said barrier film and said blister pack against said different pressure areas.

11. The device defined in claim 1, further comprising cutting means for cutting said barrier film after said film has been laminated to said blister pack.

12. Method for laminating a barrier film to a blister pack comprising the following steps:

placing a blister pack on a two-cycle carriage assembly;

reciprocating said carriage assembly along its linear axis into a housing during one cycle and out of said housing during one cycle; and preventing a barrier film from contact with said blister pack during one cycle, and contacting said barrier film to said blister pack during said other cycle to apply said film to said blister pack.

13. The method defined in claim 12, further comprising the step of cutting said barrier film after it has been laminated to said blister pack.

14. The method defined in claim 12, wherein said laminating method includes preventing said barrier film from contact with said blister pack by initially retracting said barrier film from contact with said blister pack when said carriage assembly is reciprocated into said housing.

15. The method defined in claim 12, wherein said laminating method includes placing said blister pack on a grate attached to said carriage assembly, said grate having pressure points corresponding to the desired bonding areas of said blister pack, and film, and applying pressure through said barrier film and said blister pack against said pressure areas sufficient to bond said barrier film to said blister pack.

16. The method defined in claim 12, wherein said laminating method includes applying pressure through said barrier film and said blister pack against preselected pressure areas sufficient to bond said barrier film to said blister pack during one of said cycles.

17. The method defined in claim 12, wherein said laminating method includes preventing said barrier film from coming in contact with and being applied to said blister pack during one of said cycles when said film is applied during the other cycle.

18. The method defined in claim 17, wherein said laminating method includes preventing said barrier film from contacting said blister pack during one cycle by backing said barrier film away from said blister pack a predetermined distance.

19. The method defined in claim 18, wherein said laminating method includes applying said barrier film to said blister pack during said other cycle by advancing said barrier film toward and in contact with said blister pack.

20. The method defined in claim 12, wherein said laminating method includes preventing said barrier film from contact with said blister pack by initially retracting said barrier film from contact with said blister pack when said carriage assembly is reciprocated out of said housing.

* * * * *